US009358418B2

(12) United States Patent
Golesh et al.

(10) Patent No.: US 9,358,418 B2
(45) Date of Patent: Jun. 7, 2016

(54) EXERCISE BICYCLE FRAME WITH BICYCLE SEAT AND HANDLEBAR ADJUSTMENT ASSEMBLIES

(71) Applicant: Foundation Fitness, LLC, Portland, OR (US)

(72) Inventors: Eric Golesh, Arvada, CO (US); Andrew P. Lull, Boulder, CO (US)

(73) Assignee: Foundation Fitness, LLC, Portland, OR (US)

( * ) Notice: Subject to any disclaimer, the term of this patent is extended or adjusted under 35 U.S.C. 154(b) by 29 days.

(21) Appl. No.: 14/481,743

(22) Filed: Sep. 9, 2014

(65) Prior Publication Data

US 2015/0065308 A1 Mar. 5, 2015

Related U.S. Application Data

(63) Continuation of application No. 13/267,479, filed on Oct. 6, 2011, now Pat. No. 8,827,871.

(60) Provisional application No. 61/390,570, filed on Oct. 6, 2010, provisional application No. 61/390,572, filed on Oct. 6, 2010, provisional application No. 61/390,577, filed on Oct. 6, 2010.

(51) Int. Cl.

| | |
|---|---|
| ***A63B 21/00*** | (2006.01) |
| ***A63B 21/015*** | (2006.01) |
| ***A63B 21/22*** | (2006.01) |
| ***A63B 22/06*** | (2006.01) |
| ***A63B 23/04*** | (2006.01) |

(52) U.S. Cl.

CPC ..... *A63B 21/015* (2013.01); *A63B 21/00069* (2013.01); *A63B 21/1496* (2013.01); *A63B 21/225* (2013.01); *A63B 21/4049* (2015.10); *A63B 22/0605* (2013.01); *A63B 23/0476* (2013.01); *A63B 2225/09* (2013.01)

(58) Field of Classification Search

CPC ..... A63B 21/00
USPC ..... 482/57, 72, 61, 62
See application file for complete search history.

(56) References Cited

U.S. PATENT DOCUMENTS

| | | | | |
|---|---|---|---|---|
| 5,728,029 | A * | 3/1998 | Minoura | 482/61 |
| 6,905,445 | B1 * | 6/2005 | Lin | 482/57 |
| 2001/0031686 | A1 * | 10/2001 | Ware | 482/57 |
| 2003/0092534 | A1 * | 5/2003 | Forcillo | 482/57 |
| 2009/0227429 | A1 * | 9/2009 | Baudhuin | 482/57 |
| 2009/0286654 | A1 * | 11/2009 | Rice | 482/4 |

* cited by examiner

*Primary Examiner* — Jerome W Donnelly
(74) *Attorney, Agent, or Firm* — Polsinelli PC

(57) ABSTRACT

An indoor cycling device including a unique frame arrangement with fore and aft adjustable seat and handlebar assemblies. The assemblies support a seat and handlebars for fore and aft movement. The assemblies may include a receiver with an elongate aperture with a slider positioned therein. The slider defines a first channel receiving a moveable member. A handle is operably coupled with the member to move the member within the channel in a first direction or a second direction such that a frictionally coupling is caused between the slider and the receiver when the slider is moved in the first direction and releases the coupling when the slider is moved in the second direction.

17 Claims, 19 Drawing Sheets

EXERCISE BICYCLE FRAME WITH BICYCLE SEAT AND HANDLEBAR ADJUSTMENT ASSEMBLIES

CROSS REFERENCE TO RELATED APPLICATION

The present application is a non-provisional continuation application claiming priority to pending U.S. Nonprovisional application Ser. No. 13/267,479 titled "Exercise Bicycle Frame With Bicycle Seat and Handlebar Adjustment Assemblies" filed Oct. 6, 2011 which claims priority to U.S. Provisional Patent Application No. 61/390,570 titled "Exercise Bicycle Frame with Bicycle Seat and Handlebar Adjustment Assemblies," filed on Oct. 6, 2010, and U.S. Provisional Patent Application Nos. 61/390,572 and 61/390,577 titled "Exercise Bicycle with Mechanical Flywheel Brake" and "Exercise Bicycle with Magnetic Flywheel Brake", respectively, and each filed on Oct. 6, 2010, all of which are hereby incorporated by reference herein.

FIELD OF THE INVENTION

Aspects of the present disclosure involve an exercise bicycle and adjustment assemblies that provide fore and aft adjustment for a handlebar, a seat, or other component.

BACKGROUND

Indoor cycling is a very popular and excellent way for people to maintain and improve fitness. Generally speaking, indoor cycling revolves around an exercise bicycle that is similar to other exercise bicycles with the exception that the pedals and drive sprocket are connected to a flywheel rather than some other type of wheel. Thus, while a user is pedaling, the spinning flywheel maintains some momentum and better simulates the feel of riding a real bicycle. To further enhance the benefits of indoor cycling, fitness clubs often offer indoor cycling classes as a part of their group fitness programs. With such a program, an instructor guides the class through a simulated real world ride including simulating long steady flat sections, hills, sprints, and standing to pedal for extended periods. While numerous different forms of indoor cycles exist, many suffer from common problems. For example, many indoor cycles are hard to adjust in order to provide the proper handlebar height, seat height, and separation between the handlebar and seat for the myriad of different body sizes of the people that might use the indoor cycle. Such difficulties are exaggerated in a group setting or club environment where time is limited and people are constantly adjusting the equipment.

It is with these issues in mind, among others, that aspects of the present disclosure were conceived.

SUMMARY

One aspect of the present disclosure involves an exercise bicycle comprising a receiver comprising an elongate aperture. The receiver may be connected to a post, such as a seat post or handlebar post, and may be configured for vertical adjustment. Alternatively, the receiver may include a seat or handlebar, and be configured for fore and aft adjustment. The exercise bicycle further includes a slider positioned within the elongate aperture of the receiver, the slider defining a first channel receiving a first member, such as a wedge block, moveable within the channel, the first member defining an engagement surface. The slider may include a seat or handlebar and may be configured for relative movement to a horizontally fixed receiver. Alternatively, the slider may be connected to a post and horizontally fixed and the receiver includes a seat or handlebar, as mentioned immediately above. The exercise bicycle further includes a handle operably coupled with the first member to move the first member within the channel in a first direction or a second direction such that the engagement surface causes a coupling between the slider and the receiver when the slider is moved in the first direction and releases the coupling when the slider is moved in the second direction.

The slider may define a second channel transverse to the first channel. The second channel may receive a second member, such as a second wedge block configured to interact with the first wedge block such that horizontal motion of the first wedge block translates to vertical motion of the second wedge block, within the second channel. In this configuration, the handle is operably coupled with the first member to move the first member within the channel in the first direction to drive the second member to engage the receiver, the engagement with the receiver causing a frictional coupling between the slider and the receiver, the handle operably coupled with the first member to move the first member within the channel in the second direction to release the engagement between the second member and receiver to allow relative movement between the slider and the receiver.

Another aspect of the present disclosure involves an exercise bicycle comprising a down tube extending angularly and upwardly from a rear portion to a front portion. The exercise bicycle further includes a seat tube extending upwardly and rearwardly from the rear portion of the down tube. In one particular example, the down tube is orientated at an angle of between 40 and 44 degrees and the seat tube is angled rearwardly at an angle of between 70 and 74 degrees. A brace extends rearwardly from the rear portion of the down tube to a rear support member and extends forwardly to a front support member. The exercise bicycle further includes a fork assembly extending from a position rearward of the front portion of the down tube to the front support member. In one particular implementation, a flywheel s mounted between a first fork and a second fork of the fork assembly and the flywheel having a radius of about 430 millimeters. Finally, a head tube is coupled with the front portion of the down tube.

The exercise bicycle may further include adjustable seat and handlebar assemblies adjustably supported by the seat tube and head tube, respectively. The assemblies support a seat and handlebars for fore and aft movement. The assemblies are similar in form and include a receiver comprising an elongate aperture. A slider is positioned within the elongate aperture of the receiver. The slider defines a first channel receiving a member moveable within the first channel. The member defines a first engagement surface. Finally, a handle is operably coupled with the member to move the member within the channel in a first direction or a second direction such that the engagement surface causes a coupling between the slider and the receiver when the slider is moved in the first direction and releases the coupling when the slider is moved in the second direction. The exercise bicycle may provide a space separation between the adjustable seat assembly and the adjustable handlebar assembly in a range of about 527 millimeters and about 627 millimeters.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. It should be noted that the drawings are not necessarily to scale; however the emphasis instead is being placed on illustrating the principles of the inventive concepts. Also, in the drawings the like reference characters refer to the same parts or similar throughout the different views. It is intended that the embodiments and figures disclosed herein are to be considered illustrative rather than limiting.

DETAILED DESCRIPTION

Figure 1:
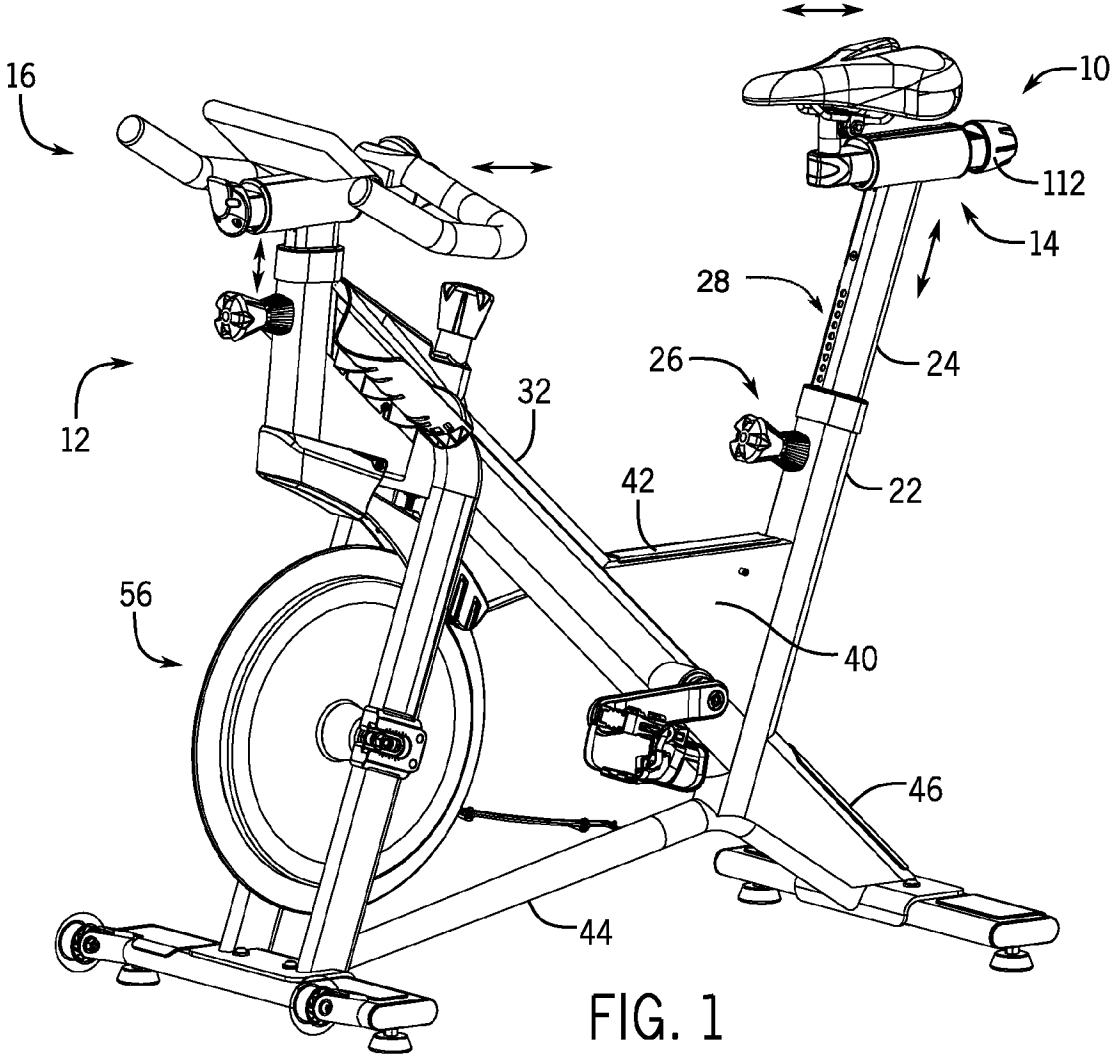
FIG. 1 is an isometric view of an exercise bicycle.
Figure 2:
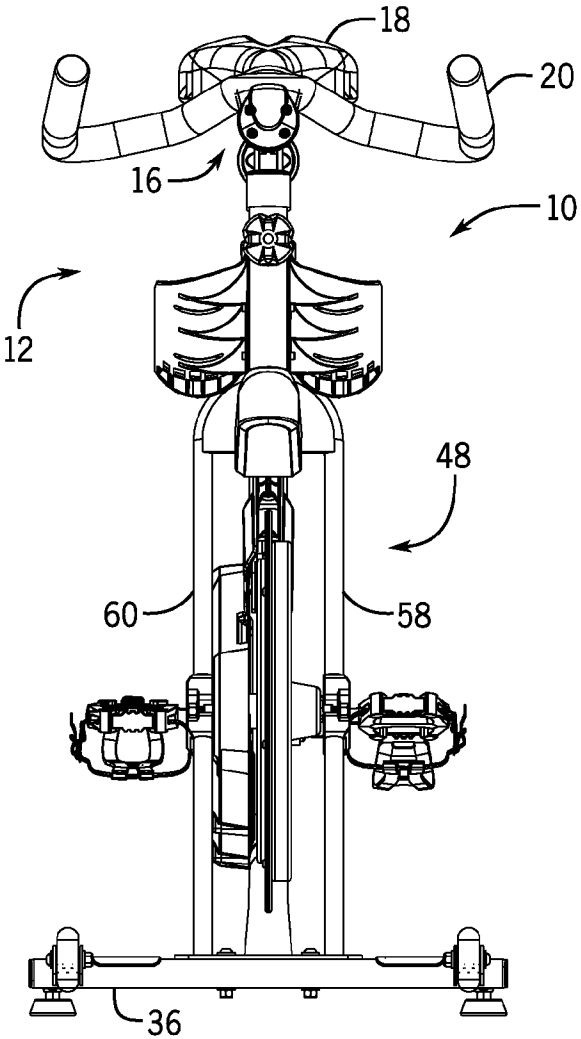
FIG. 2 is a front view of the exercise bicycle shown in FIG. 1.
Figure 3:
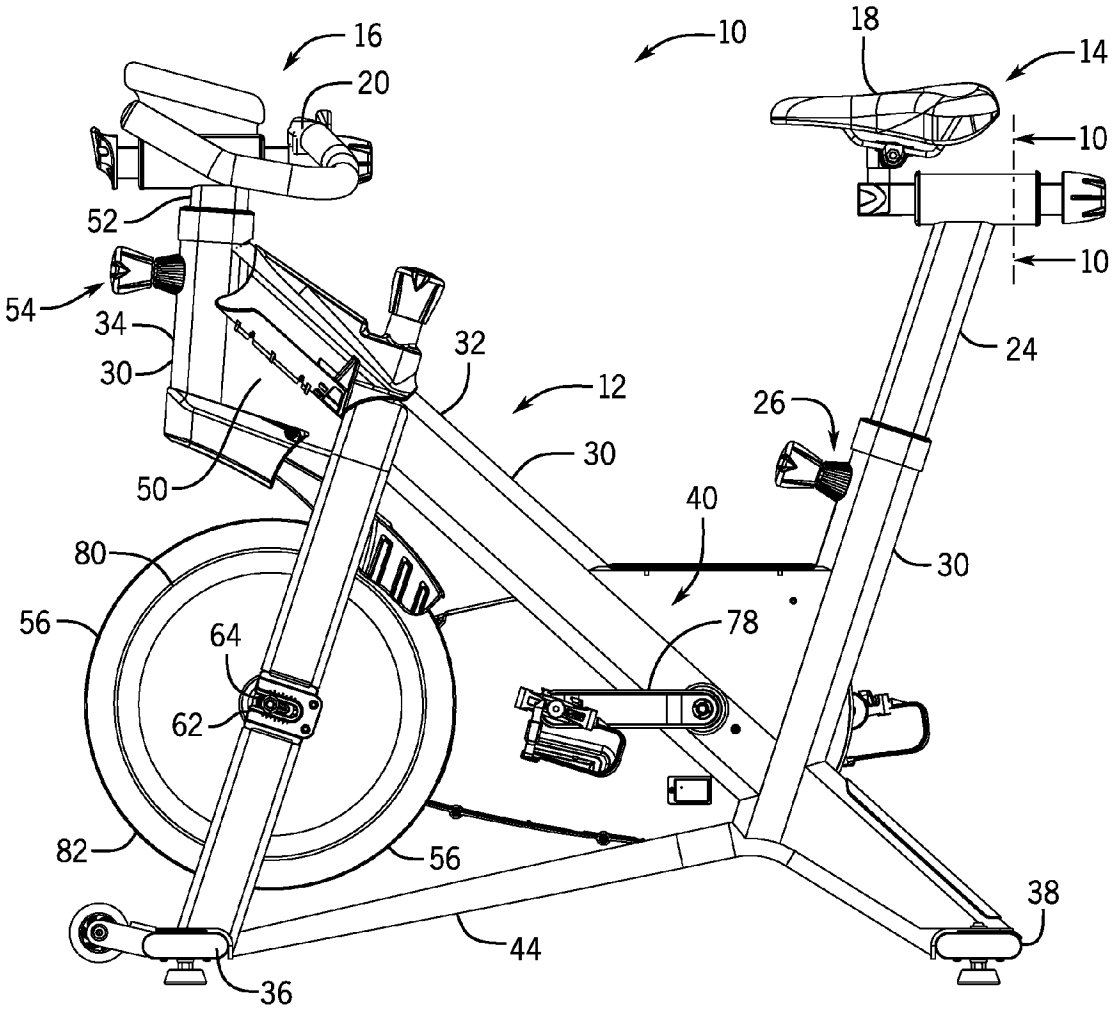
FIG. 3 is a left side view of the exercise bicycle shown in FIG. 1.
Figure 4:
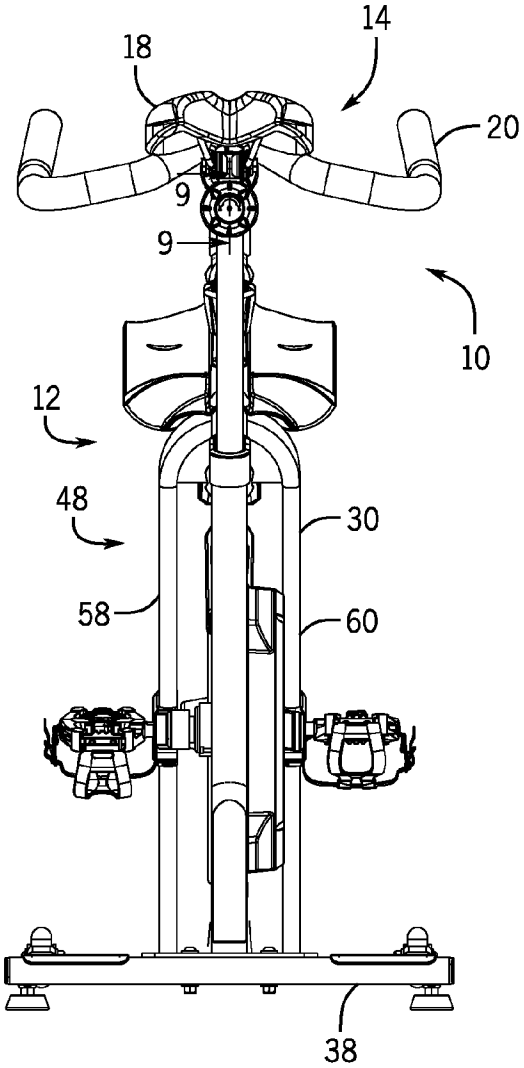
FIG. 4 is a rear view of the exercise bicycle shown in FIG. 1.
Figure 5:
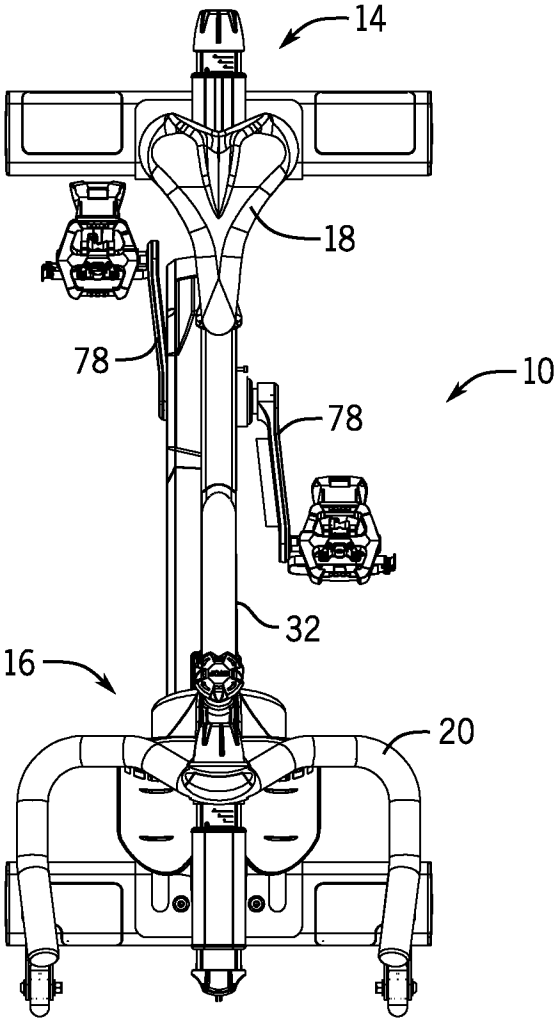
FIG. 5 is a top view of the exercise bicycle shown in FIG. 1.
Figure 6A:
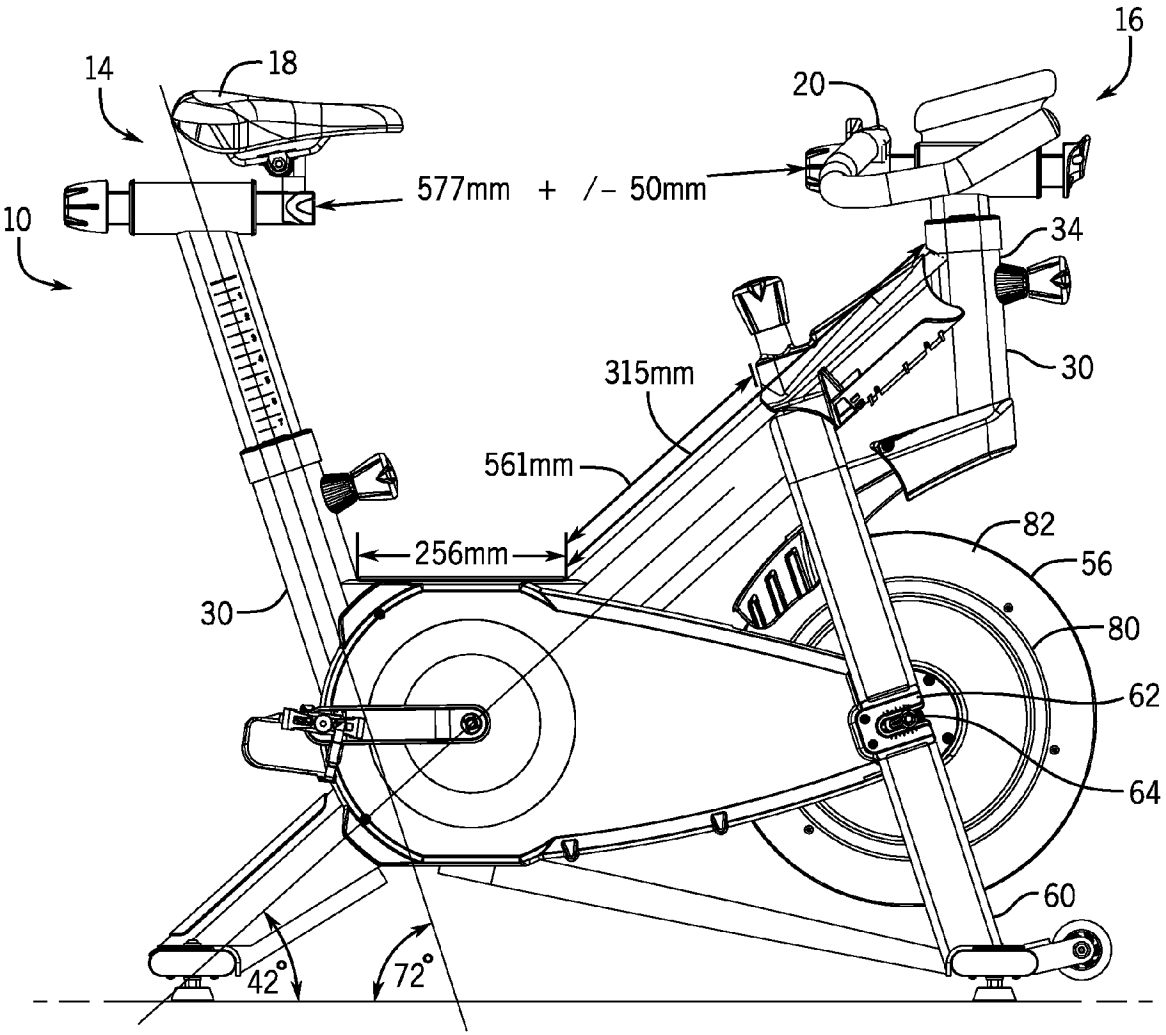
FIG. 6A is a right side view of the exercise bicycle shown in FIG. 1.
Figure 6B:
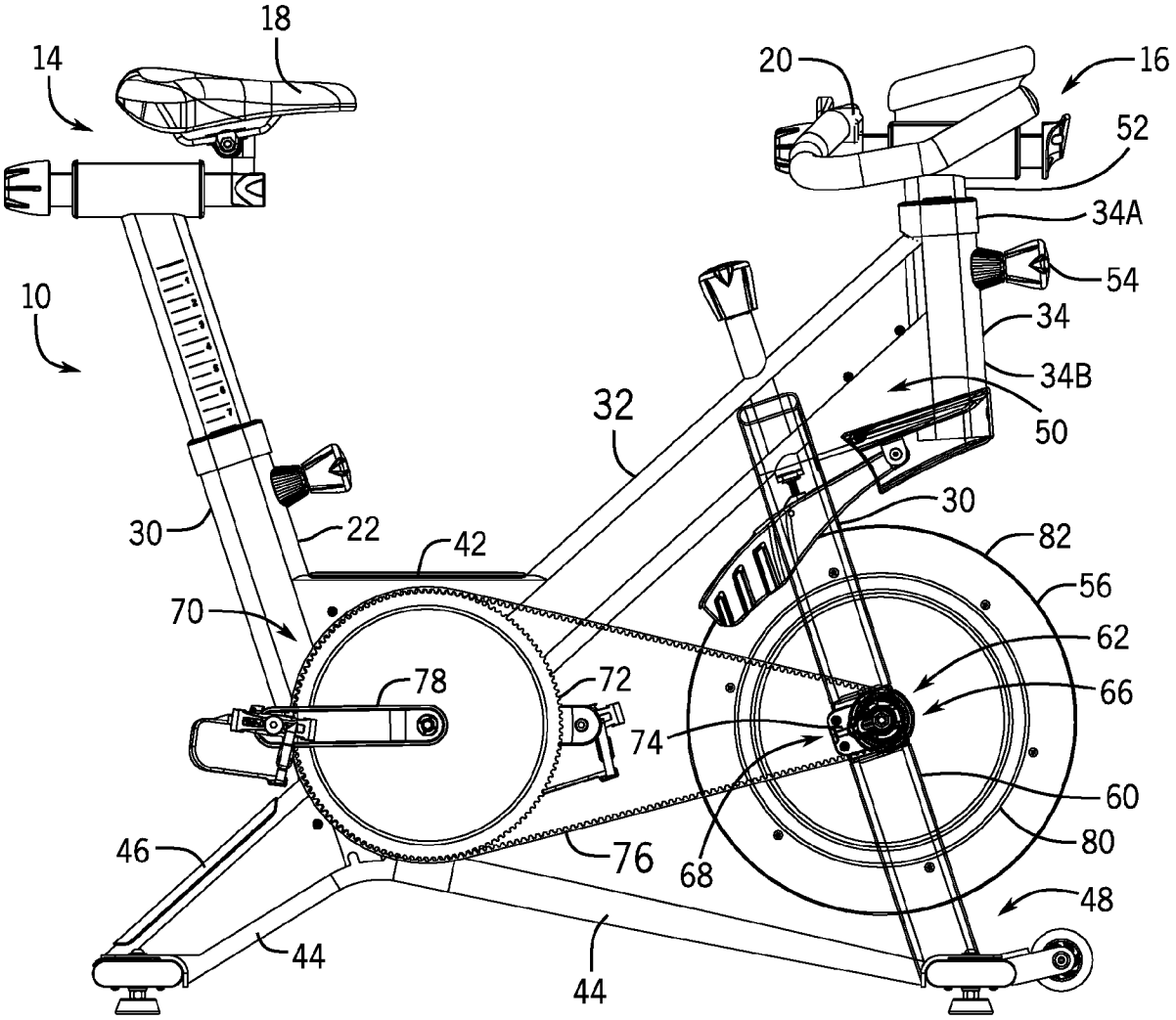
FIG. 6B is a right side view of the exercise bicycle shown in FIG. 1 with a chain guard removed to illustrate a drive sprocket and a flywheel sprocket, along with a chain connected therebetween.
Figure 7:
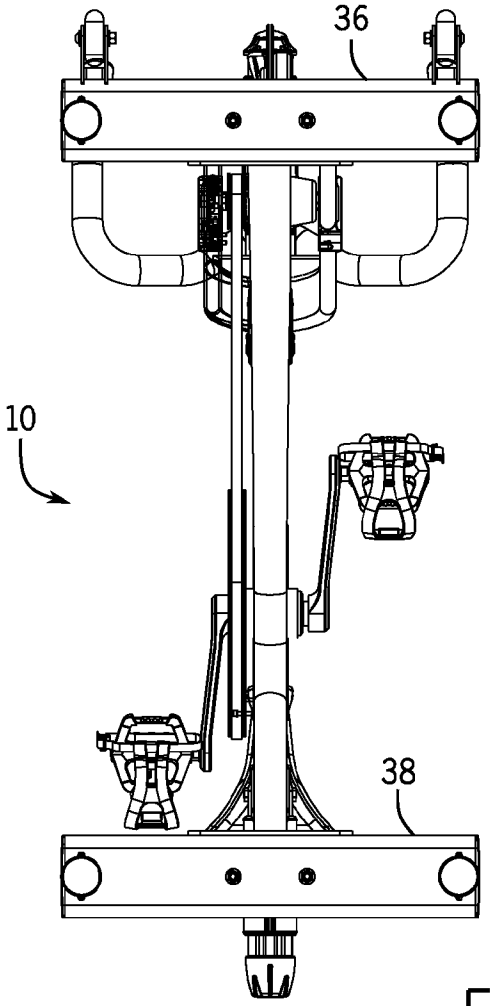
FIG. 7 is a bottom view of the exercise bicycle shown in FIG. 1.

Aspects of the present disclosure involve an exercise bicycle. The exercise bicycle includes various features that provide adjustability of the seat and handlebar positions, provide space for riders of various sizes, and provide space for mounting and dismounting the exercise bicycle, among other advantages. The exercise bicycle includes fore and aft adjustment mechanisms for the seat and handlebars that improve on conventional arrangements. Fore and aft adjustment may be set along any fore and aft position and is not constrained as in conventional designs. Many of the moving components of the adjustment mechanism, except for a knob that a user turns are captured within a slider and a receiver, providing for an elegant design with many mechanical components hidden. The frame design provides exceptional space between the seat, handlebars and frame members, while maintaining industry standard dimensioning for proper rider use and ergonomic adjustment of the exercise bicycle. For example, a head tube is positioned forward of the handlebars and eliminated as a point of contact for a rider, rearward movement of the seat and forward movement of the handlebars opens space providing the rider with less contact points and the down tube is relatively low and positioned at a relatively shallow angle providing excellent step over height and space.

Referring now to FIGS. 1-7, one example of an exercise bicycle 10 is shown. The exercise bicycle is configured for use by a variety of riders in a club environment or for a single or limited number of riders in a home or other personal use environment. The exercise bicycle includes a frame 12 adjustably supporting an adjustable seat assembly 14 at the rear of the frame and adjustably supporting an adjustable handlebar assembly 16 at the front of the frame. The adjustable seat and handlebar assemblies provide fore and aft adjustment of a respective seat 18 and handlebar 20. Further, the seat and handlebar assemblies may be vertically adjusted and fixed at various possible positions. Hence, the exercise bicycle provides for many different possible seat and handlebar positions to fit different riders and to provide riders with different configurations depending on the exercise being performed.

The frame includes a seat tube 22 that receives a seat post portion 24 of the seat assembly 14. The seat post may be moved up and down relative to the seat tube to adjust the height of the seat assembly, and particularly to adjust the height of the seat 18 that is a part of the seat assembly. A pop pin 26 is connected with the seat tube and is configured to engage one of a plurality of apertures 28 defined in the seat post, and thereby secure the seat at a desired height. The pop pin may be spring-loaded such that it is biased in the locked position engaging the aperture.

The pop pin is shown extending forwardly from the seat tube. This configuration provides easy access for a rider to move the seat up or down during exercise. For example, indoor cycling classes often include some time where the user is standing and pedaling rather than seated, and at such times the rider may move the seat to a lower position. The pop pin is positioned for easy access by the rider. It is possible, however, to position the pop pin on the back side of the seat tube or at another location. Additionally, it is possible to use other mechanisms to facilitate seat height adjustment with or without pop pins. For example, a pawl on the fore and aft seat and handlebar assemblies may be used to vertically adjust the seat post (or tube) as well as the handlebar post.

In one particular implementation, the seat tube is rearwardly angled at approximately 72 degrees. The seat tube angle, along with other adjustment and dimensional relationships discussed herein, is optimized so that riders of all sizes can best fit the exercise bicycle. The seat tube 22, along with other frame members discussed herein, is extruded aluminum and defines a racetrack-shaped cross section 30 with opposing flat side walls 30A and opposing semicircular side walls 30B. The seat post 24 defines a substantially matching racetrack-shaped cross section of a smaller dimension in order to fit within the seat tube. Other frame member shapes and materials may be used, such as steel square tubing or steel round tubing, in the construction of the frame assembly. However, the extruded aluminum race track shaped tubing provides a unique balance between strength, overall exercise bicycle weight and aesthetic appearance. Additionally, while the seat post is shown as telescoping out of the seat tube, this relationship may be reversed such that the post fits over the tube. This relationship may also be reversed for other tube and post arrangements discussed herein.

Returning again to the discussion of the frame 10, a down tube 32 extends from a lower rear area of the exercise bicycle to an upper forward area of the exercise bicycle. Particularly, the down tube extends between a bottom portion of the seat tube 22 and a head tube 34. The down tube is also a racetrack type extruded aluminum member. The down tube, in one particular arrangement, is at angle of about 42 degrees. The angular relationship of the down tube may be measured relative to a horizontal surface upon which the exercise bicycle sits or relative to a line between a front support member 36 and a rear support member 38. The down tube is welded to the bottom of the seat tube, although other means of attachment and arrangements are possible. Further, a triangular rear gusset 40 with a substantially flat top 42 is connected to and above the intersection of the seat tube 22 and the down tube 32. The rear gusset, like other frame members and arrangements, may be altered or removed. In the exercise bicycle frame illustrated, the gusset provides structural support to the seat tube and seat assembly, and also provides a step for riders mounting the exercise bicycle as well as other advantages. In the example shown, the flat top portion of the gusset, which provides the step, is slightly longer than 10 inches measured between the seat tube and down tube, a dimension not achievable by other designs which employ different frame configurations, larger flywheels and different gearing configurations.

A brace 44 extends from the rear support member 38 upward to the bottom of the seat tube 22 and then forward and downward to the front support member 36. A lower gusset 46 is connected between the rear portion of the brace, the top of the rear support member 44, and the lower rear portion of the seat tube 22. The lower gusset is in substantial alignment and of substantially similar dimension as the down tube. The front support member 36 is connected to the front forks 48 and extends outwardly and transversely from each fork.

The head tube 34 is connected to the front of the down tube 32. A portion 34A of the head tube extends upwardly from the down tube and a portion 34B of the head tube extends downwardly from the head tube. A front gusset 50 is connected between the downwardly extending portion 34B of the head tube and the down tube 32. The head tube receives a handlebar post 52 that extends downwardly from the fore and aft adjustable handlebar assembly 16. The handlebar post may be moved vertically relative to the head tube to adjust the height of a handlebar assembly, and particularly to adjust the height of a handlebar 20 of the handlebar assembly. A second pop pin 54 is connected with the head tube 34 and is configured to engage one of a plurality of apertures (not shown) defined in the handlebar post, and hence secure the handlebars at a desired height. Other mechanisms may also be used in place of the pop pin, and the position of the pop pin or any other mechanism may be altered in alternative exercise bicycle implementations.

In the frame configuration illustrated herein, the front fork assembly 48, which supports a flywheel 56 between opposing left 58 and right 60 fork legs, is coupled to the down tube 32 at a point between the head tube 34 and the seat tube 22. In the particular arrangement shown, the down tube is about 561 mm between the rear of the head tube and the intersection between the rear gusset 40 and the down tube, and the fork is about 315 mm between the rear of the fork and the same intersection.

In the frame configuration shown, the forks are set at about the same angle as the seat tube. A pair of mounting brackets 62, also referred to as "drop outs", are integrated in the fork legs to support a flywheel axle 64 and the flywheel. The exercise bicycle discussed herein is particularly configured for indoor cycling and therefore includes a flywheel. It is nonetheless possible to deploy the frame and other components discussed, whether alone or in combination, in an exercise bicycle that does not include a flywheel. The drop outs have matching forwardly opening channels 66 that are perpendicular to the long axis of the fork legs, in one embodiment. Thus, the forward opening of the channels is higher than the rear of the channels. An adjustment screw 68 protrudes into the opening. The design is advantageous in that it allows a user to mount the flywheel from the open front area of the exercise bicycle without any hindrance, such as if the channels opened rearwardly. Moreover, the channels receive the axle and support the flywheel while a user adjusts the axle position by way of the adjustment screws to tension the chain and center the flywheel, such as during assembly or maintenance. It is also possible to orient the channels in other ways, such as horizontally and level, and include a lip or other retaining member at the opening of the channel to help retain the flywheel before the axle is locked in.

In many conventional exercise bicycle designs, the head tube is aligned with the forks. The exercise bicycle shown herein, however, has the head tube positioned at the front of the frame and forward of the fork assembly 48. Additionally, as discussed herein, fore and aft adjustment of the handlebars occurs relative to the head tube such that the rear of the handlebars (and the adjustment knob) is the rearward most component of the handlebar assembly 16 relative to the user rather than the fixed head tube and handle bar post (stem) in conventional designs. Hence, the handlebars may be moved forward relative to the user opening up space between the handlebars and the seat. In many conventional designs, the handlebars are above and forward the head tube and the head tube is the rearward most component; thus, any possible fore or aft adjustment of the handlebars occurs with the head tube remaining stationary and does not provide additional space for the user between the seat and the handlebar.

The frame assembly 12 further includes a crank assembly 70 configured to drive the flywheel 56. The drive sprocket is rotably supported in a bottom bracket 55 supported in the down tube 32. In one example, the crank assembly includes a single drive sprocket 72 and the flywheel similarly includes a single flywheel sprocket 74 of a smaller diameter than the drive sprocket. A chain 76 connects the drive sprocket to the flywheel sprocket, although other mechanisms, such as a belt, may be used to connect the sprockets. The drive sprocket is fixed to a pair of crank arms 78 and the flywheel is fixed to the flywheel sprocket such that the drive sprocket and flywheel sprocket do not freewheel. Hence, with reference to FIG. 6B, clockwise rotational force on the crank arms, such as in conventional forward pedaling, rotates the flywheel in a clockwise manner. However, if the rider discontinues exerting a pedaling force on the cranks, the spinning flywheel will continue, via the chain, to drive the crank arms. It is, however, possible to include freewheel mechanisms with the drive or flywheel sprocket or other components.

In one particular implementation, the drive sprocket 72 includes 72 teeth and the flywheel sprocket 74 includes 15 teeth. A range of sprocket teeth counts are possible such as 70-74 teeth and 13 to 17 teeth, and an even broader range of 45 to 75 teeth on the drive sprocket. Moreover depending on the design, other sprocket arrangements are possible, as well as arrangements with a derailleur and multiple sprockets at both ends. This particular sprocket arrangement facilitates the use of a smaller flywheel 56 of 430 mm radius, relative to other designs. With a smaller flywheel, a shallower down tube angle (e.g. 42 degrees) is possible providing a larger gusset step size (e.g. 10 inches) and a larger area between the seat and handlebar assemblies relative to other exercise bicycle frame designs.

As discussed above, the frame provides for the height adjustment of the seat assembly 14 (with seat 18) and the handlebar assembly 16 (with handlebars 20) by way of the interactions between the seat tube 22, seat post 24 and rear pop pin assembly 26 and the head tube 34, handlebar post 52 and front pop pin assembly 54, respectively. The exercise bicycle discussed herein also provides fore and aft adjustment of the seat and/or the handlebars through respective fore and aft seat and handlebar adjustment assemblies. In one possible implementation and with reference to FIG. 6A, when the seat height is about the same as the handlebar height, a range of about 527 mm (where the handlebars are completely rearward and the seat is completely forward) to about 627 mm (when the handlebars are completely forward the seat completely rearward) separate the seat and handlebar assemblies providing exceptional open space for the rider to mount and dismount the cycle.

Turning first to the seat adjustment assembly 14, FIGS. 8-11 illustrate the fore and aft adjustable seat assembly. In this example implementation, a receiver 82 is connected to the seat post 24. The receiver, which is extruded aluminum in one particular implementation, defines a slider aperture 84 arranged along the horizontal center line of the exercise bicycle and roughly parallel with the surface that the exercise bicycle is set on. The slider aperture receives a slider 86 that may be moved fore and aft within the slider aperture. Additionally, the slider may be fixed at various positions relative to the receiver. The seat 18 is attached to the slider (such as at a front end of the slider); hence, by adjusting and fixing the slider relative to the receiver, the fore and aft position of the seat may be adjusted.

Figure 10:
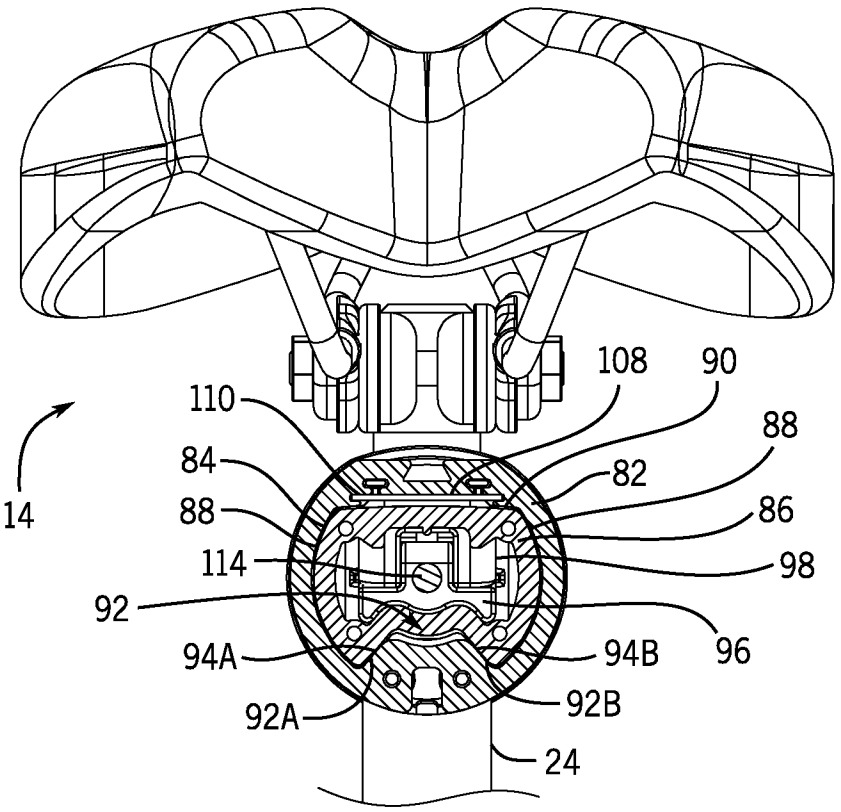
FIG. 10 is a section view taken along line 10-10 of FIG. 4.
Figure 11:
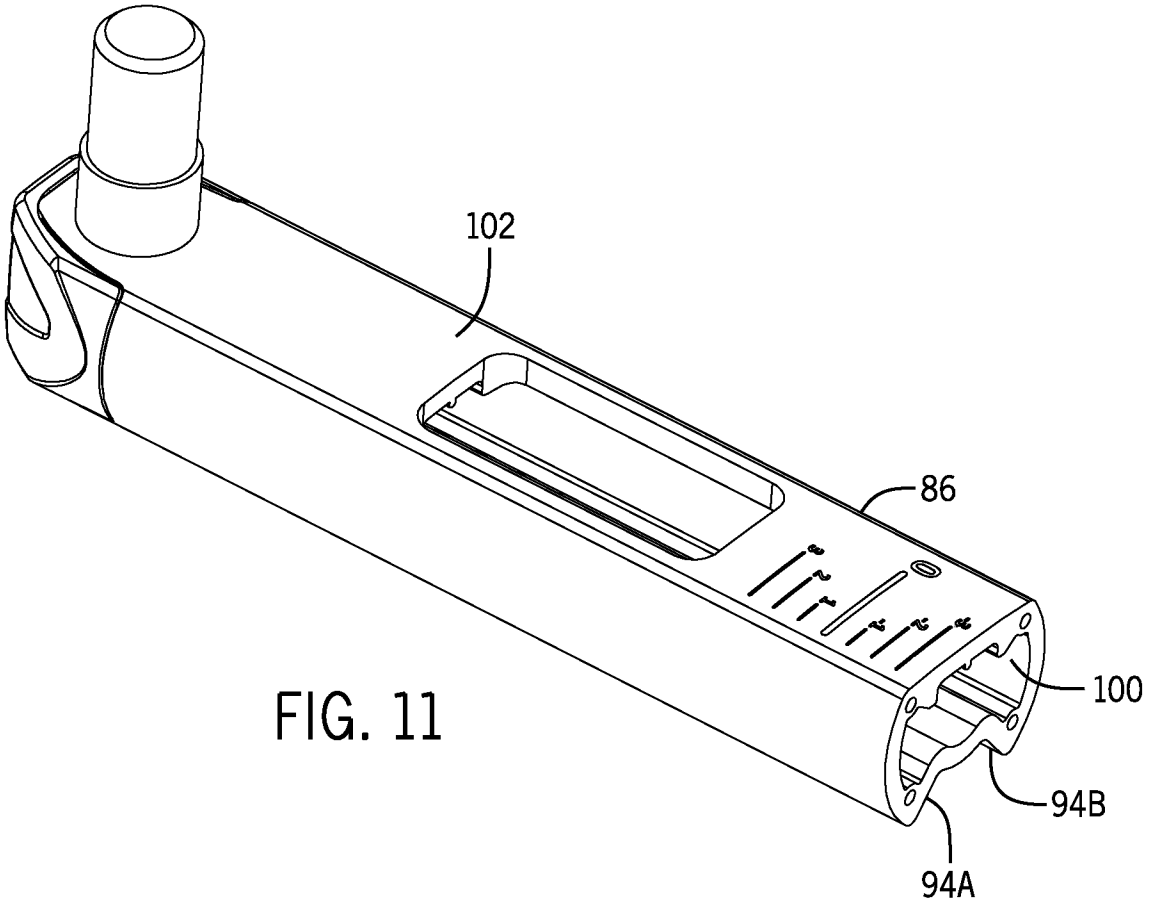
FIG. 11 is an isometric view of a slider mechanism for supporting a seat.

The slider aperture, in cross section as shown in FIG. 10, defines a complex shape with curved sides 88 connected by a substantially flat top 90 and an inverted W-shaped bottom 92. The bottom surface includes two bearing or engagement surfaces (92A, 92B) that form a frictional engagement to matching surfaces (94A, 94B) on the slider 86. The outer surface of the slider substantially matches the complex shape of the slider aperture albeit with a slightly smaller shape so that the slider may move horizontally relative to the slider aperture.

A lower wedge 96 and an upper wedge 98 are positioned within the slider 86. Particularly, the slider defines a lower wedge aperture 100 along the longitudinal center of the slider and a top wedge aperture 102 intersecting the lower wedge aperture. The lower wedge 96 is configured to move horizontally within the slider, particularly within the lower wedge aperture 100, while the upper wedge is trapped within and configured to move vertically within the top wedge aperture 102. The top wedge aperture extends through the substantially flat top surface of the slider. Stated differently, the first wedge (lower wedge) moves within a first aperture transverse to a second aperture (the upper wedge aperture) where the second upper wedge moves.

Figure 8:
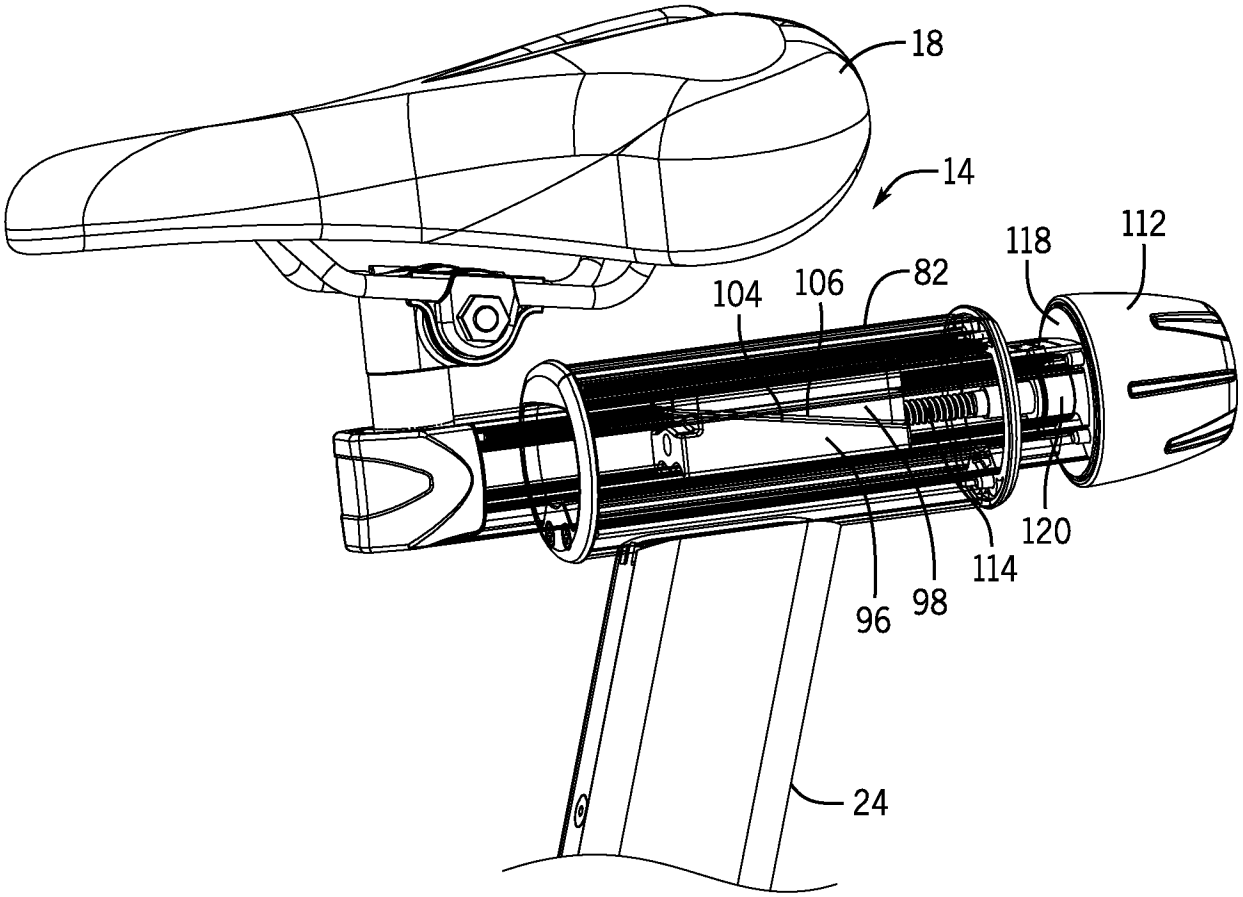
FIG. 8 is an isometric view of a seat adjustment assembly, with certain components of the view transparent.

As shown in the FIG. 8, the lower wedge 96 has a sloped upper surface 104 and the upper wedge 98 has a matching sloped lower surface 106. These surfaces are in contact. With the upper wedge constrained in the vertical wedge aperture, aft or rearward horizontal movement of the sloped surface of the lower wedge presses on the sloped surface of the upper wedge driving the upper wedge upward to lock the slider relative to the receiver. On the other hand, fore or forward horizontal movement of the lower wedge allows the upper wedge to drop down to release the slider so that the horizontal position of the slider and the seat can be adjusted. Therefore, fore and aft movement of the lower wedge translates into down and up movement of the upper wedge to release or unlock the slider for adjustment and to lock the slider into position when the seat is properly positioned.

The slider 86 is trapped within the slider aperture 84 of the receiver 82. A strike plate, in one particular example, 108 is positioned above the wedge aperture 102 and is of sufficient length so that the upper wedge 98 will press on the strike plate in the forward most and rearward most positions. The strike plate is steel and is constrained in a channel 110 extruded in the aluminum receiver. The upper wedge pushes upward against the strike plate when the slider is being locked relative to the receiver. When the seat assembly 14 is being locked into a particular fore or aft position, the lower wedge also presses down on the slider 86 causing the outer lower surface (94A, 94B) of the slider to frictionally engage the respective bearing surfaces (92A, 92B) of the receiver. Particularly, the slider and the receiver engage on the outer portions of the inverted W but do not engage between the outer portions, as shown in FIG. 10. Hence, in one particular implementation, the fore or aft position of the slider relative to the receiver may be locked in position through a frictional engagement between the upper wedge and the strike plate and along the opposing lower surfaces of the slider and slider aperture of the receiver.

A knob 112 is positioned at the rear of the slider 86 or otherwise at an end of the slider. The knob is fixed to a threaded shaft 114 that is threaded into a threaded aperture 116 in the bottom wedge 96. The shaft is captured in the slider such that rotation of the shaft engages the threaded aperture of the lower wedge to move the wedge fore and aft. In one particular arrangement, an end cap 118 defining a smooth bore or tube section 120 is fixed to the end of the receiver. A bearing 122 is pressed in the tube section of the end cap and the bearing rotatably supports the shaft 114. A clip 124 or shoulder is positioned on the shaft adjacent the bearing and end cap. The clip prohibits the shaft from moving rearward relative to the slider. The knob 112 is fixed to the end of the shaft, with the bearing and the end cap sandwiched between the clip and the knob. Hence, the knob prevents the shaft from moving forward relative to the slider. Thus, the shaft can only be rotated by turning the knob and does not move fore and aft relative to the slider. When a user rotates the knob, the knob and shaft rotate relative to the slider, end cap, bearing, etc. The rotating shaft, in turn, moves the lower wedge fore and aft through engagement between the shaft and the threaded aperture of the lower wedge. The lower wedge, in turn, engages or disengages the upper wedge to lock the fore and aft position of the seat or release the assembly so the seat can be moved.

Figure 9A:
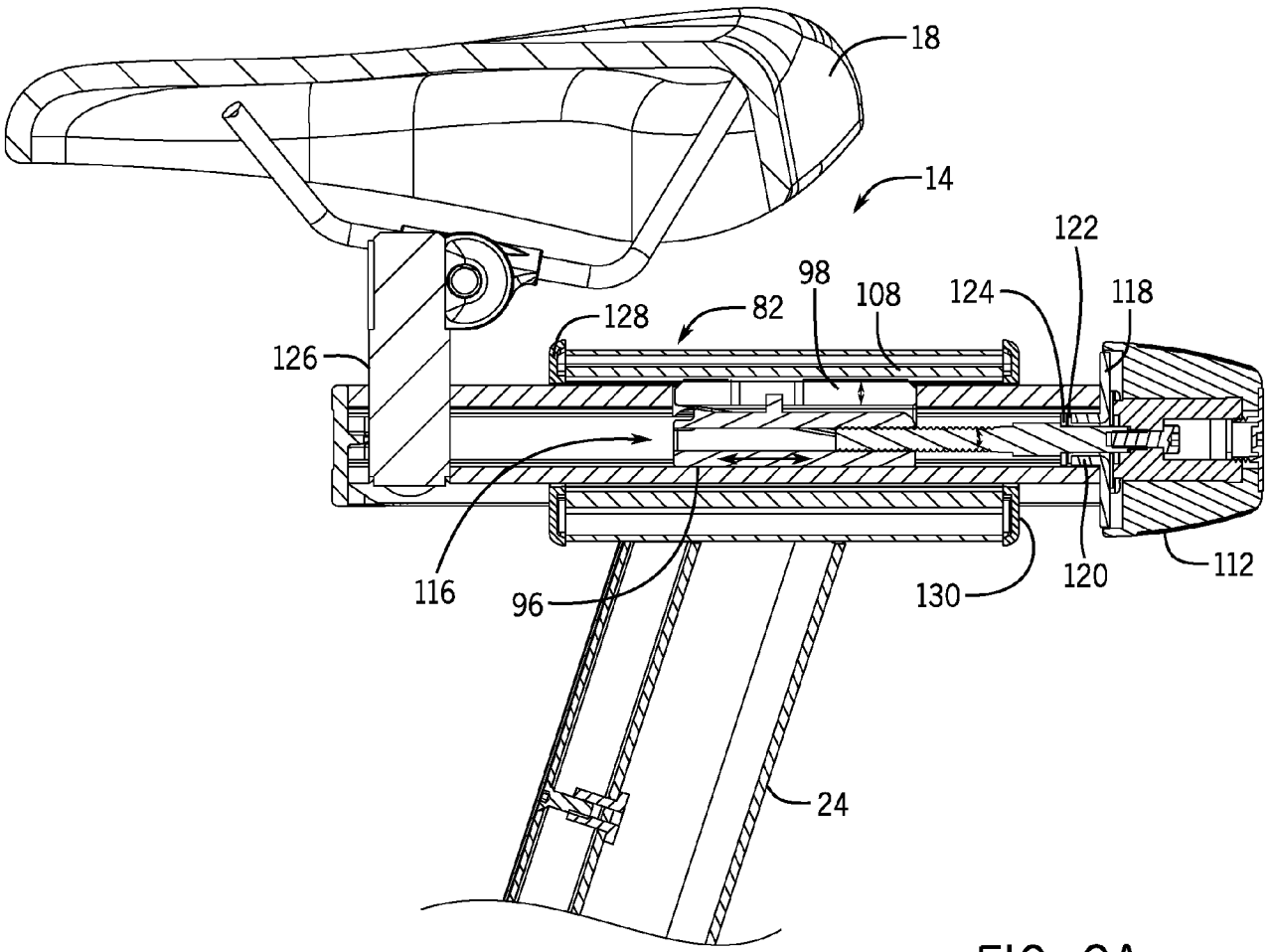
FIG. 9A is a section view taken along line 9-9 of FIG. 3, and illustrating the seat assembly positioned about midway between its forward most and rearward most positions.
Figure 9B:
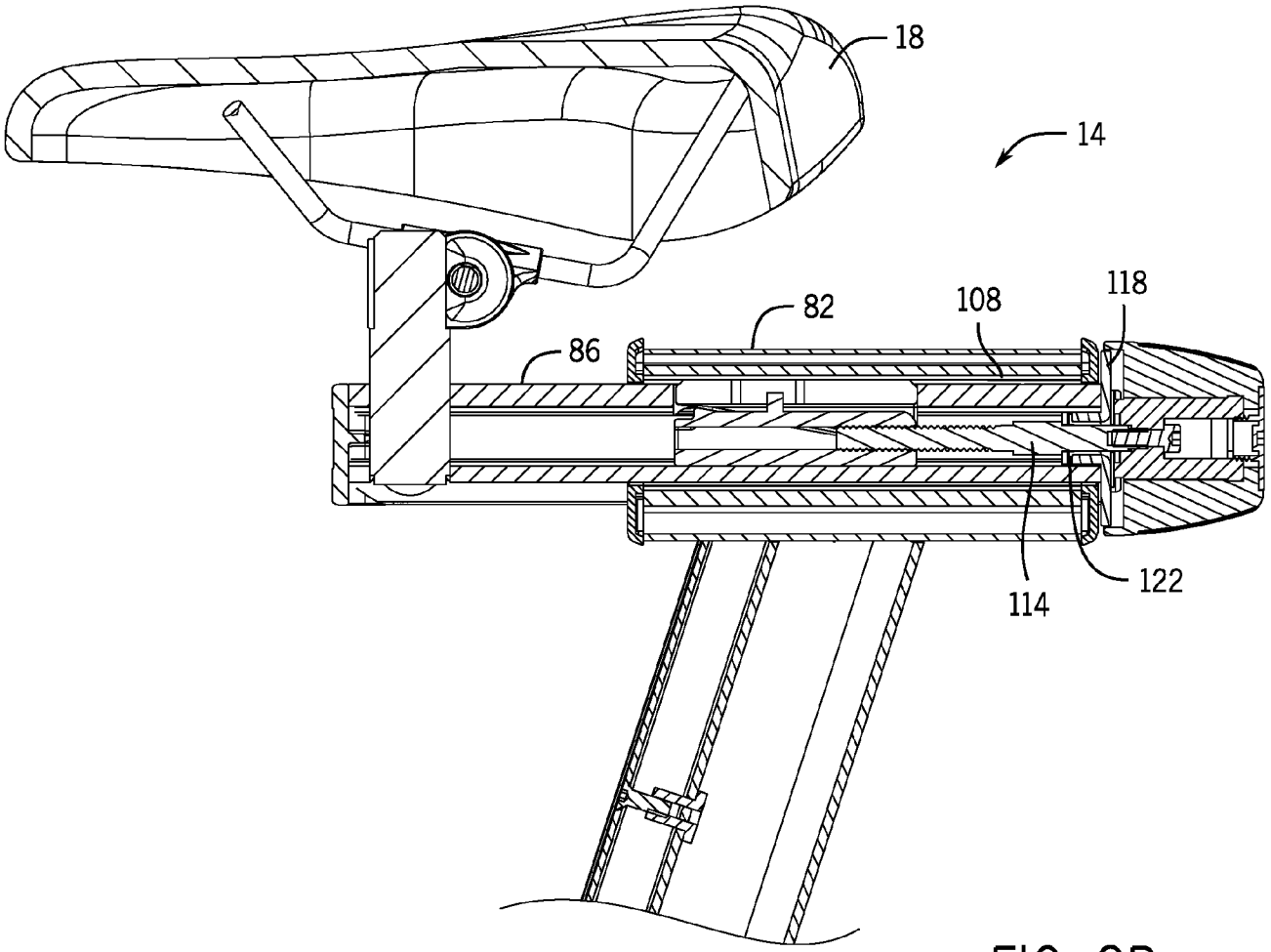
FIG. 9B is section view similar to FIG. 9A with the seat assembly in its forward most position.
Figure 9C:
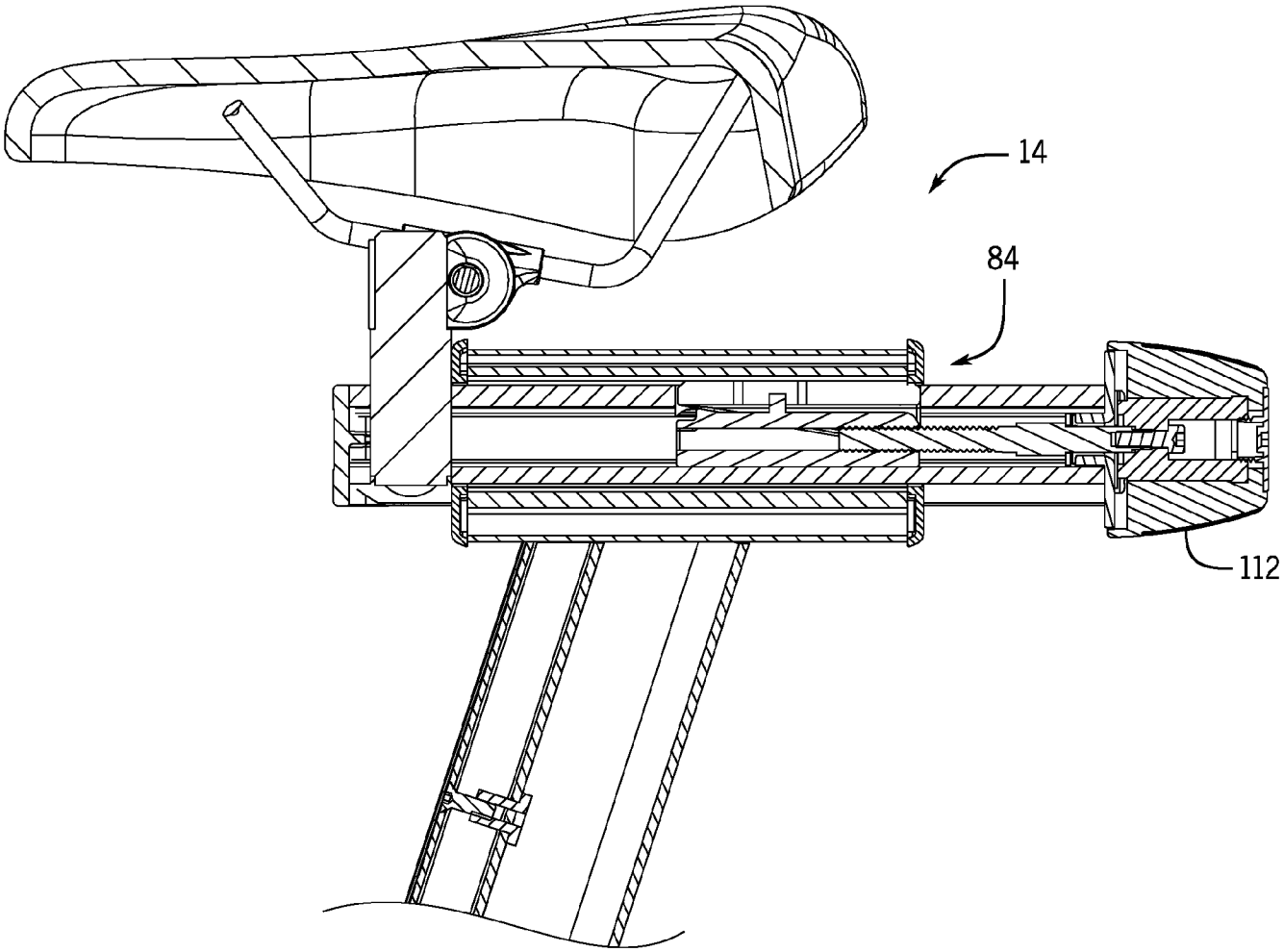
FIG. 9C is a section view similar to FIG. 9A with the seat assembly in its rearward most position.

A stub 126 extends upwardly at the forward end of the slider 86. The seat is attached to the stub. A cap 128 prevents the slider from being completely withdrawn rearwardly from the receiver. Hence, in the rearward most aft position, the cap 130 abuts the receiver, as shown in FIG. 9C. Similarly, the stop cap at the opposing end of the receiver prevents the slider from being completely withdrawn forwardly from the receiver. Hence, in the forward most position, the stop cap abuts the receiver, as shown in FIG. 9B.

While in both the adjustable fore and aft seat and handlebar assemblies, two wedges are shown, it is also possible to eliminate the upper wedge or alter the shape of either or both wedges. For example, the lower wedge and the strike plate can be dimensioned so that the lower wedge directly engages the strike plate with increasing or decreasing force as the wedge is moved aft or fore. In such an arrangement, the engagement of the lower wedge directly with the strike plate will push the strike plate upward and drive the slider down to create the appropriate frictional engagement. Similarly, the lower wedge may include a sloped surface as currently shown and the upper wedge may be a square or rectangular block, where the sloped, or otherwise oblique surface of the lower wedge, engages a corner of the block to press the block upward. The engaged corner of the block may include a bevel to distribute the load imparted by the lower wedge.

Figure 12:
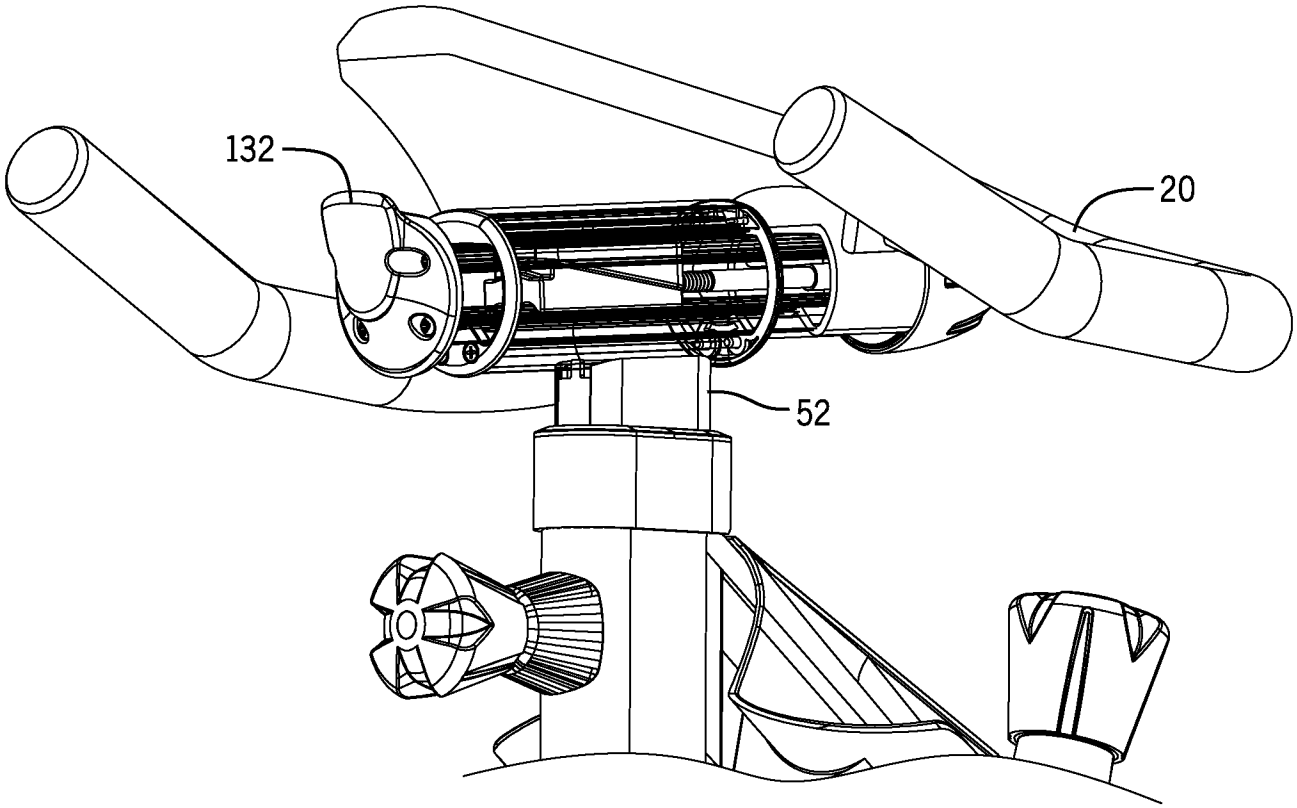
FIG. 12 is an isometric view of a handlebar adjustment assembly, with certain components of the view transparent.
Figure 13A:
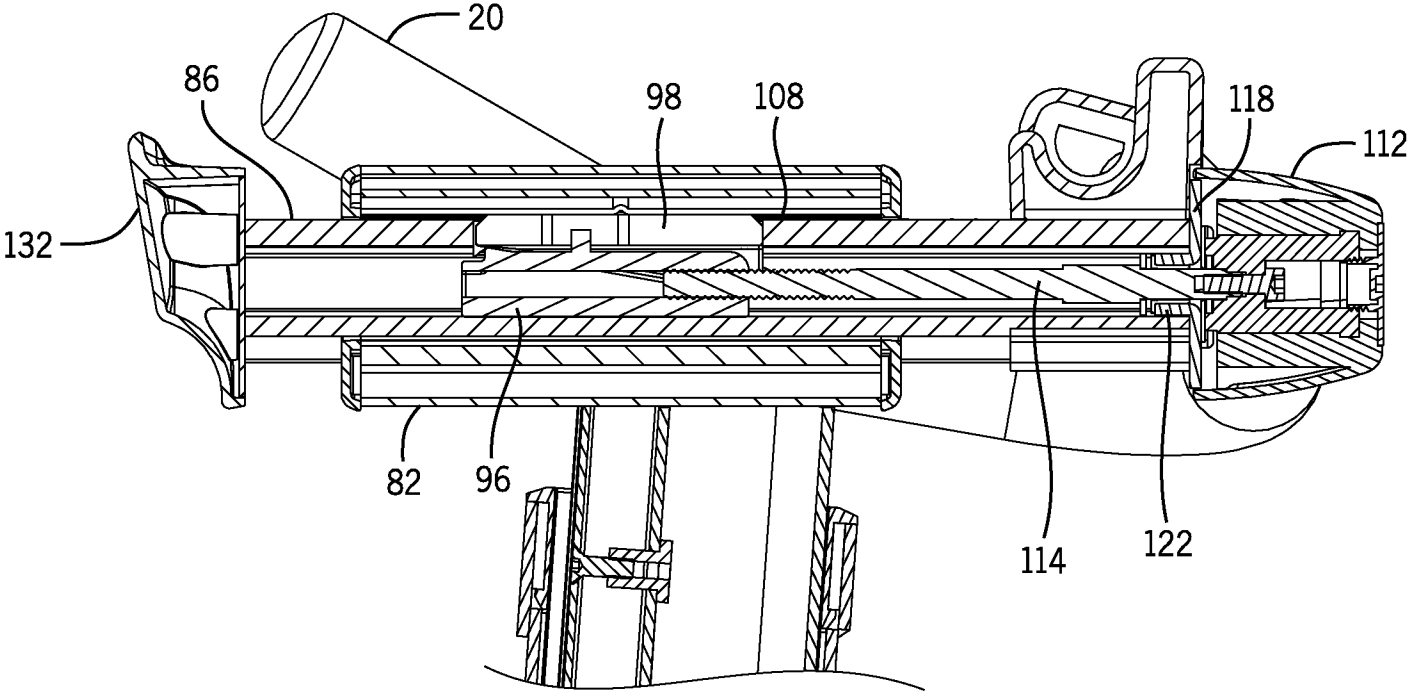
FIG. 13A is a section view taken along line 13-13 of FIG. 3, and illustrating the handlebar assembly positioned about midway between its forward most and rearward most position.
Figure 13B:
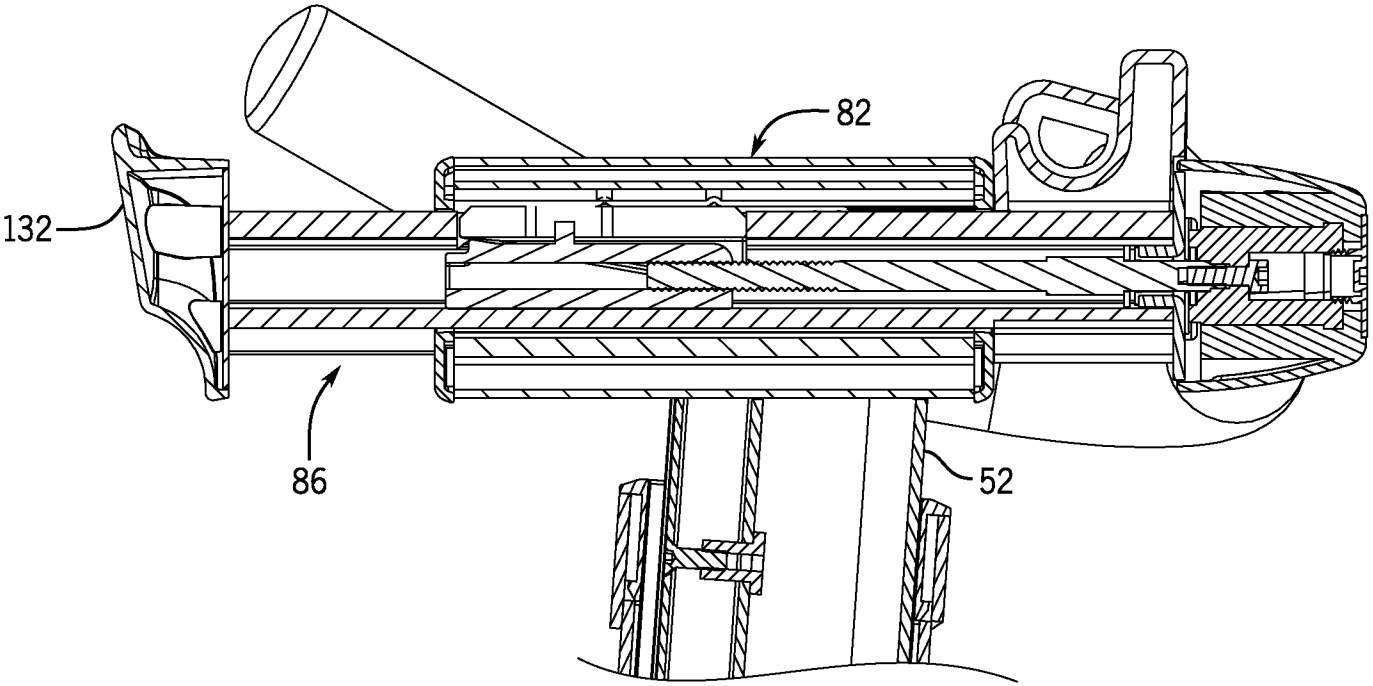
FIG. 13B is a section view similar to FIG. 13A with the handlebar assembly in the forward most position.
Figure 13C:
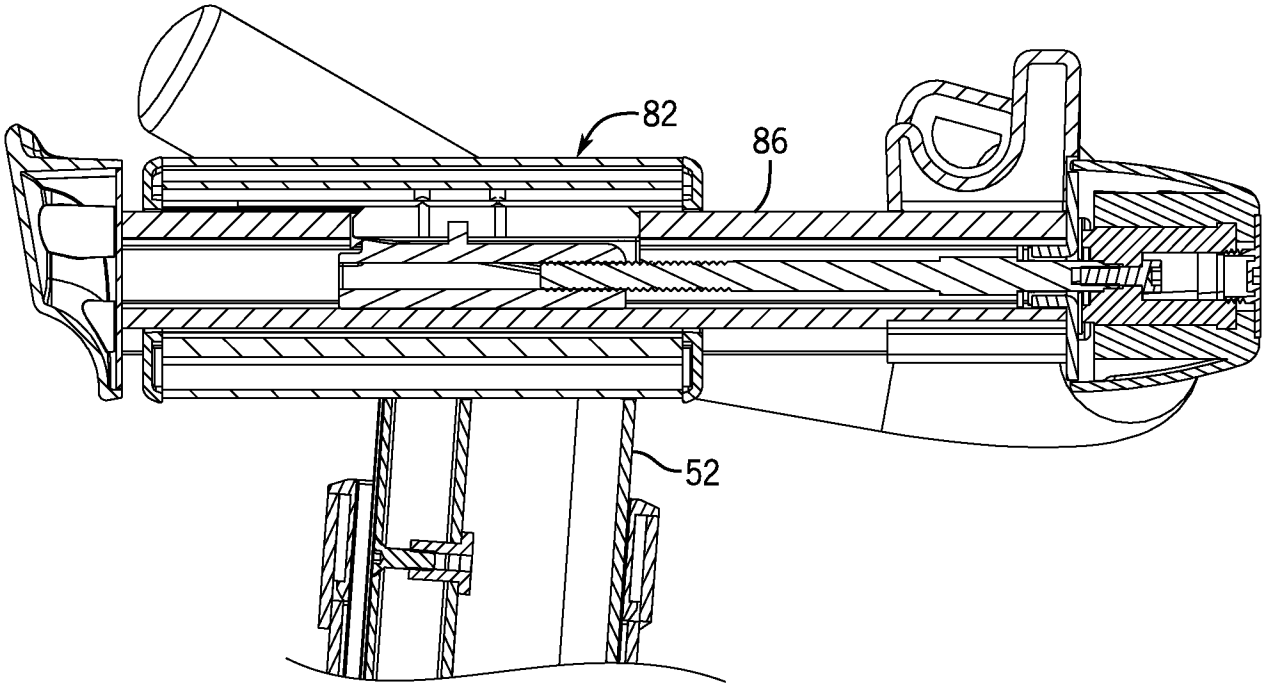
FIG. 13C is a section view similar to FIG. 13A with the handlebar assembly in the rearward most position.
Figure 14:
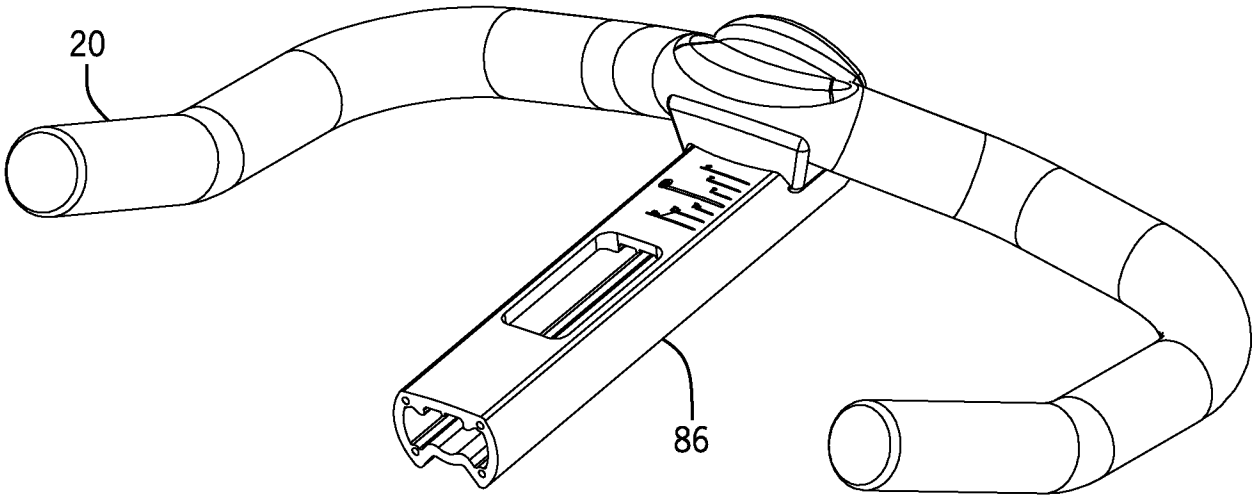
FIG. 14 is an isometric view of a slider mechanism supporting a handlebar.

One example of a handlebar adjustment assembly 16 is illustrated in FIGS. 12-14. The handlebar adjustment assembly is similar in form and function to the seat adjustment assembly and therefore like components will be referenced as such. The handlebar fore and aft adjustment assembly includes a slider 86 that may be positioned fore and aft within and relative to a receiver 82. The receiver is attached to the handlebar post 52. Accordingly, the receiver may be moved up and down relative to the head tube. The handlebar 20 is positioned at one end of the slider and an end cap 132 is positioned at the opposing end of the slider. As shown in FIGS. 13B and 13C, the handlebar or the end cap abuts the receiver depending on whether the handlebar is positioned most forwardly (FIG. 13B) or most rearwardly FIG. 13C).

In the implementation discussed above, the slider mechanism moves relative to the receiver, and the receiver is attached to the seat post or handlebar post. Further, the seat or handlebars are connected to the slider mechanism. It is possible to alter this relationship and use the wedge (cam block) mechanism discussed herein. For example, in such an alteration, the slider structure is coupled to the post, at the forward or rearward end of the slider structure. Hence, the slider is fixed relative to the frame. At the end opposite the coupling to the post, the knob and shaft are supported. The slider includes substantially the same wedge block configuration or the alternative discussed herein. The receiver, in the altered implementation, has the seat or handlebars attached to it and it is configured to move fore and aft relative to the slider. A user locks or unlocks the receiver and moves it fore and aft to adjust the position in a like manner as discussed herein.

It also possible, to replace the knob shaft fore and aft lower wedge block actuation with a lever arm and with a camming surface configured to engage the receiver strike plate or the upper wedge block. In such an implementation, the lever arm is fixed to the slider or the receiver, and is configured push the camming surface up against the upper wedge block to create the same form of frictional engagement between the slider and the receiver. It is also possible to replace the knob and shaft with a lever arm and shaft coupled with the lower wedge block. The lever arm would act to move the shaft fore and aft rather than rotate the shaft. The shaft is fixed to the lower wedge block, and hence fore and aft movement of the lower wedge block would act to force the upper wedge block upward to allow it to fall downward, locking or unlocking engagement between the slider and receiver.

Although various representative embodiments of this disclosure have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments and do not create limitations, particularly as to the position, orientation, or use of the disclosure unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. An exercise bicycle comprising:

an exercise bicycle frame including:

a down tube extending angularly and upwardly from a rear portion to a front portion;

a seat tube extending upwardly and rearwardly from the rear portion of the down tube;

a fork assembly extending from a position rearward of the front portion of the down tube and a head tube to a front support member; and the head tube coupled with the front portion of the down tube, the head tube supporting a handlebar assembly translationally supporting a handlebar such that the handlebar may be adjusted fore and aft between positions rearward relative to the head tube.

2. The exercise bicycle of claim 1 further comprising a handlebar operably coupled with the handlebar assembly on a rearward portion of the handlebar assembly, the handlebar assembly comprising:

a first tube comprising an elongate aperture; a second tube positioned within the elongate aperture of the first tube, the second tube defining a channel receiving a member moveable within the channel, the member defining an engagement surface; and a handle operably coupled with the member to move the member within the channel in a first direction or a second direction.

3. The exercise bicycle of claim 1 wherein the handlebar assembly comprises a first receiver comprising a first elongate aperture; a first slider positioned within the first elongate aperture of the first receiver, the first slider defining a first channel receiving a first member moveable within the first channel, the first member defining a first engagement surface; and a first handle operably coupled with the first member to move the first member within the first channel in a first direction or a second direction such that the first engagement surface causes a first coupling between the first slider and the first receiver when the first slider is moved in the first direction and releases the second coupling when the first slider is moved in the second direction.

4. The exercise bicycle of claim 3 further comprising an adjustable seat assembly adjustably supported by the seat tube, the adjustable seat assembly including a seat and comprising:

a second receiver comprising a second elongate aperture;

a second slider positioned within the second elongate aperture of the second receiver, the second slider defining a second channel receiving a second member moveable within the second channel, the second member defining a second engagement surface; and a second handle operably coupled with the second member to move the first member within the first channel in a first direction or a second direction such that the first engagement surface causes a second coupling between the second slider and the second receiver when the second slider is moved in the second direction and releases the second coupling when the second slider is moved in the second direction.

5. The exercise bicycle of claim 4 wherein a separation between the adjustable seat assembly and the handlebar assembly is in a range of about 527 millimeters to about 627 millimeters.

6. The exercise bicycle of claim 1 wherein the fork assembly includes a first fork that includes a first bracket defining a first channel with a first opening for receiving and supporting an axle of a flywheel, and a second fork that includes a second bracket defining a second channel with a second opening for receiving and supporting the axle of the flywheel, the first and second openings facing forwardly relative to the exercise bicycle.

7. The exercise bicycle of claim 6 wherein the first and second channels are orientated transverse to the respective first and second forks such that the axle is gravitationally biased away from the respective first and second openings.

8. The exercise bicycle of claim 6 wherein the flywheel has a radius of about 430 millimeters.

9. The exercise bicycle of claim 6 further comprising a crank assembly supported by the down tube and including a drive sprocket including between 70 and 74 teeth; a flywheel sprocket coupled with the flywheel, the flywheel sprocket including between 13 and 17 teeth; and a chain interconnecting the drive sprocket with the flywheel sprocket.

10. The exercise bicycle of claim 9 wherein the down tube is orientated at an angle of between 40 and 44 degrees and the seat tube is angled rearwardly at an angle of between 70 and 74 degrees.

11. The exercise bicycle of claim 10 further comprising a gusset positioned at an intersection between the down tube and the seat tube, the gusset defining a step of about 254 millimeters.

12. The exercise bicycle of claim 11 wherein the fork assembly is coupled with the down tube between 310 and 320 millimeters above the gusset and the head tube is coupled with the down tube between 555 and 565 millimeters above the gusset.

13. The exercise bicycle of claim 1 further comprising a brace extending rearwardly from the rear portion of the down tube and extending forwardly to a front support member.

14. The exercise bicycle of claim 13 wherein the brace comprises a first section extending forwardly and downwardly from an area adjacent an intersection between the down tube and the seat tube, the brace further comprising a second section extending rearwardly and downwardly from the intersection.

15. An exercise bicycle frame comprising:

a down tube extending angularly and upwardly from a rear portion to a front portion;

a seat tube extending upwardly and rearwardly from the rear portion of the down tube;

a fork assembly extending from a position rearward of the front portion of the down tube to a front support member;

a head tube coupled with the front portion of the down tube; and means for adjustably supporting a handlebar coupled with the head tube.

16. The exercise bicycle frame of claim 15 further comprising means for adjustably supporting a seat coupled with the seat tube.

17. The exercise bicycle of claim 1 wherein the head tube is positioned at a substantially vertical position.

* * * * *